US010012479B2

(12) United States Patent
Boviall et al.

(10) Patent No.: US 10,012,479 B2
(45) Date of Patent: Jul. 3, 2018

(54) BALLISTIC BARRIER

(71) Applicants: Michael Boviall, Post Falls, ID (US); Patrick Harrington, Post Falls, ID (US)

(72) Inventors: Michael Boviall, Post Falls, ID (US); Patrick Harrington, Post Falls, ID (US)

( * ) Notice: Subject to any disclaimer, the term of this patent is extended or adjusted under 35 U.S.C. 154(b) by 39 days.

(21) Appl. No.: 15/049,788

(22) Filed: Feb. 22, 2016

(65) Prior Publication Data

US 2017/0241749 A1 Aug. 24, 2017

(51) Int. Cl.

| | |
|---|---|
| ***F41H 5/02*** | (2006.01) |
| ***F41H 5/24*** | (2006.01) |
| ***F41H 5/06*** | (2006.01) |
| *F41H 5/013* | (2006.01) |
| *F41H 11/08* | (2006.01) |

(52) U.S. Cl.

CPC ..... *F41H 5/026* (2013.01); *F41H 5/06* (2013.01); *F41H 5/24* (2013.01); *F41H 5/013* (2013.01); *F41H 11/08* (2013.01)

(58) Field of Classification Search

CPC ..... E04H 17/16; E04H 17/165; E04H 17/166; E04H 17/1421; E04H 17/1434; E04H 17/1443; E04H 2017/1447; E04H 2017/1452; E04H 2017/146; E04H 2017/1465; E04H 2017/1473; F41H 5/013; F41H 5/06; F41H 5/24; F41H 11/00; F41H 13/00; F41H 5/12; F41H 5/026

USPC ..... 256/24, 26, 31, 73, 65.02, 65.03, 65.04, 256/65.06

See application file for complete search history.

(56) References Cited

U.S. PATENT DOCUMENTS

| | | | | |
|---|---|---|---|---|
| 1,899,735 A * | 2/1933 | McClintock | ..... | E05G 7/002 109/10 |
| 4,067,547 A * | 1/1978 | Peters | ..... | A01K 3/00 256/23 |
| 5,452,641 A * | 9/1995 | Kariya | ..... | E05G 1/026 109/78 |

(Continued)

FOREIGN PATENT DOCUMENTS

| | | | | |
|---|---|---|---|---|
| DE | 4237798 A1 * | 5/1994 | ..... | F41H 5/02 |
| EP | 2975198 A1 * | 1/2016 | ..... | F41H 5/026 |
| WO | WO-2015157179 A1 * | 10/2015 | ..... | F41H 5/026 |

*Primary Examiner* — Josh Skroupa
*Assistant Examiner* — Cory B Siegert
(74) *Attorney, Agent, or Firm* — Craig R. Rogers; Simple IP Law, P.C.

(57) ABSTRACT

A ballistic barrier may include a plurality of panels, each panel having a plurality of slats arranged downwardly at an angle with respect to horizontal. When an incoming bullet strikes a slat, its energy is redirected and the bullet is deflected downward toward the ground. Various thicknesses, materials, and dimensions of slats can be used. In addition, the slats can be arranged at an angle somewhere between 0 and 90 degrees, depending on the desired application. All of the slats may be arranged at substantially the same angle, or they may be arranged at different angles. Backer plates may further be included to prevent bullets from travelling beyond the fence. The backer plates may be constructed and attached in a manner that permits airflow between adjacent backer plates. A facing may be included to prevent people from climbing the fence slats.

20 Claims, 6 Drawing Sheets

(56) References Cited

U.S. PATENT DOCUMENTS

| | | | | |
|---|---|---|---|---|
| 5,639,069 | A * | 6/1997 | McClure | E04H 17/1408 256/24 |
| 5,723,807 | A * | 3/1998 | Kuhn, II | F41H 5/013 89/36.02 |
| 6,672,195 | B1 * | 1/2004 | Plattner | B64C 1/1469 89/36.04 |
| 8,783,661 | B1 * | 7/2014 | Payne | E04H 17/161 256/24 |
| 9,151,074 | B2 * | 10/2015 | Walters | E04H 17/1421 |
| 9,404,716 | B2 * | 8/2016 | Shoshan | F41H 5/00 |
| 9,470,481 | B2 * | 10/2016 | Livesey | F41H 5/023 |
| 2010/0206158 | A1 * | 8/2010 | Neethling | F41H 5/023 89/36.02 |
| 2011/0107904 | A1 * | 5/2011 | Queheillalt | F41H 5/023 89/36.02 |
| 2012/0279383 | A1 * | 11/2012 | Carberry | E04H 9/10 89/36.02 |
| 2014/0123842 | A1 * | 5/2014 | Kahmann | F41H 5/06 89/36.02 |
| 2014/0373707 | A1 * | 12/2014 | Herden-Ostendorff | F41H 5/013 89/36.02 |
| 2015/0268005 | A1 * | 9/2015 | Keren | F41H 5/026 89/36.02 |
| 2015/0354926 | A1 * | 12/2015 | Gibson | F41H 5/24 89/36.04 |

* cited by examiner

FIG. 13A
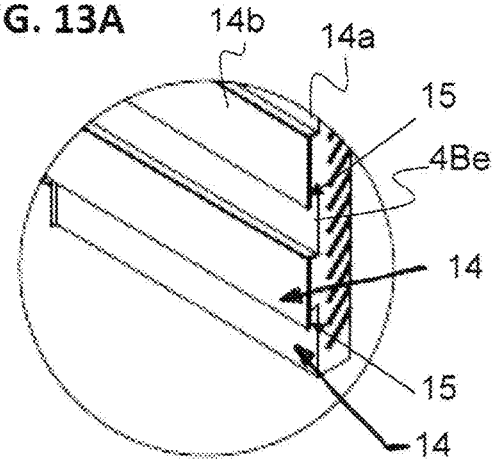
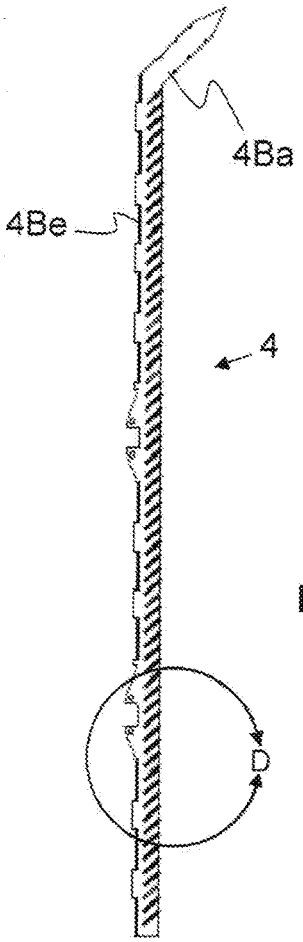
FIG. 13B
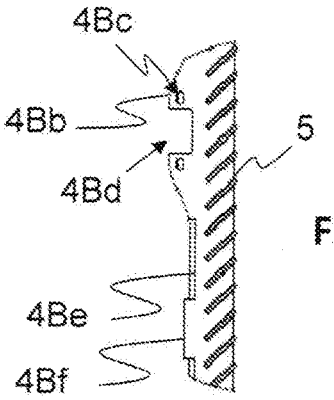
FIG. 13C

BALLISTIC BARRIER

PRIORITY CLAIM

This application is a non-provisional of, and claims priority from, U.S. Provisional Patent Application Ser. No. 62/126,918, filed Mar. 2, 2015, the contents of which are hereby incorporated herein by reference in their entirety.

TECHNICAL FIELD

The present invention relates generally to barrier systems, such as walls or fences, and more particularly, to barrier systems capable of protecting against small arms or high caliber rifle fire.

BACKGROUND OF THE INVENTION

There have been all types of protective barriers (e.g., walls or fences), used throughout history. One area in particular in which protective barriers have been implemented is to protect humans and equipment from incoming gun fire. Unfortunately, current ballistic resistant fences are not cost effective and are difficult and expensive to install and implement.

It would therefore be desirable to have an effective ballistic barrier that is relatively easy and inexpensive to install and implement. The ballistic barrier should be designed to protect high dollar equipment and human lives within the barrier that could otherwise be harmed or killed by incoming bullets.

SUMMARY OF THE INVENTION

The present inventive concepts relate to a ballistic barrier for protecting people and objects within the barrier from incoming ballistic fire (such as small arms or high caliber rifle fire, for instance). The present inventive concepts provide a ballistic barrier that is easy to install, is relatively inexpensive, and provides effective resistance to incoming ballistic fire. One possible application for such a fence is for utility stations that house millions of dollars worth of electrical equipment. Numerous other applications are also contemplated.

According to principles of the present inventive concepts, a ballistic fence is provided with the capability of redirecting incoming bullets, preferably toward the ground. Rather than immediately stopping incoming bullets, the ballistic fence preferably redirects the bullets to the ground before protected equipment and/or humans within the barrier (but outside of a "kill zone") can be damaged, hurt, or killed. A "kill zone" may, for instance, be anywhere within about 10 feet of the inside of the fence.

More particularly, principles of the inventive concepts provide a ballistic fence constructed having a plurality of ballistic panels, each panel comprising a plurality of slats arranged at a downward angle with respect to a horizontal plane. The ballistic fence can be constructed having a plurality of fence posts installed in the ground with one or more rails connected between the posts. The ballistic panels can be connected to the rails. The panels can, for instance, be bolted or welded in position along the rails.

Each panel can include a plurality of vertical ribs (or slat supports) that can be attached vertically along the rails. Each of the vertical ribs can include a plurality of slots, each slot being configured to receive a slat therein. The slots can be angled downward at a desired angle (e.g., somewhere between 0 and 90 degrees with respect to horizontal, or somewhere between 0 and 90 degrees with respect to vertical, for instance about 45 degrees). The slats can be welded or otherwise attached in place within the slots in the slat supports (ribs). The slats may be formed of steel or another desired material.

By arranging the slats at a downward angle with respect to horizontal, incoming bullets may be deflected downward rather than having a vertically arranged slat attempting stop it. The angle of orientation of the slats may therefore preferably be somewhere between (and including) 1 to 89 degrees from horizontal, and most preferably around 45 degrees. By deflecting the bullet rather than attempting to stop it entirely, the inventive concepts are able to decrease the amount of energy that is applied to the object (e.g., the slats) that the bullet is hitting.

If the slats were placed completely vertically, they may not be strong enough to keep a bullet from penetrating the slat. However, when the slats are arranged at an angle with respect to vertical (e.g., arranged at an incline or decline) only a small portion of the bullet makes direct contact with panel before the bullet energy is redirected.

The slats may, for instance, be constructed of a desired material and have a sufficient thickness such that they are resistant to bullets. By arranging the slats at an angle (for example an angle that is greater than 0 but less than 90 degrees from vertically downward), rather than requiring the slats to absorb the full energy of an incoming bullet, the bullets may be deflected downward toward the ground behind the fence. The distance beyond the fence that the bullets are permitted to travel may be determined by the angle at which the slats are arranged and a height at which the bullets strike the ballistic barrier.

One or more backer plates may further be provided to stop the bullets from traveling past the backer plate and beyond the ballistic fence. In an embodiment having a backer plate, for instance, the bullet would hit the angled slat directing the bullet downward or upward at an angle where it would then hit the backer plate. The backer plate would then stop and/or redirect the bullet again, preferably straight down or substantially straight down to the ground. The backer plates can be arranged to provide ventilation between the plates to permit air to circulate through the fence, for instance, for applications where equipment within the fence requires cooling.

A serrated sheet metal, corrugated sheet metal, wire mesh, or other facing may further be arranged on an outside portion of the ballistic barrier to prevent people from climbing up the fence panels.

Although most elements of this particular embodiment can be made of steel, tube steel, and plate steel, any other suitable material or materials could also be used. In construction, each piece is preferably sized in proportion to the rest of the fence. In the case of steel, for instance, the connections can be solid welds, bolt connections, or other desired connections. Any appropriate connections known within the art are contemplated as being within the scope of the inventive concepts.

BRIEF DESCRIPTION OF THE DRAWINGS

The foregoing and additional objects, features, and advantages of the present inventive concepts will become more readily apparent from the following detailed description, made with reference to the accompanying figures, in which:

FIG. 13A is an enlarged view of Detail B of FIG. 13;

FIG. 13B is a somewhat schematic side view of a rib for the ballistic fence assembly of FIG. 13; and FIG. 13C is an enlarged view of Detail D of FIG. 13B.

DETAILED DESCRIPTION

In the following detailed description, reference is made to the accompanying drawings, which form part thereof, and in which are shown, by way of illustration, exemplary embodiments illustrating various principles of the present invention and how it may be practiced.

Figure 1:
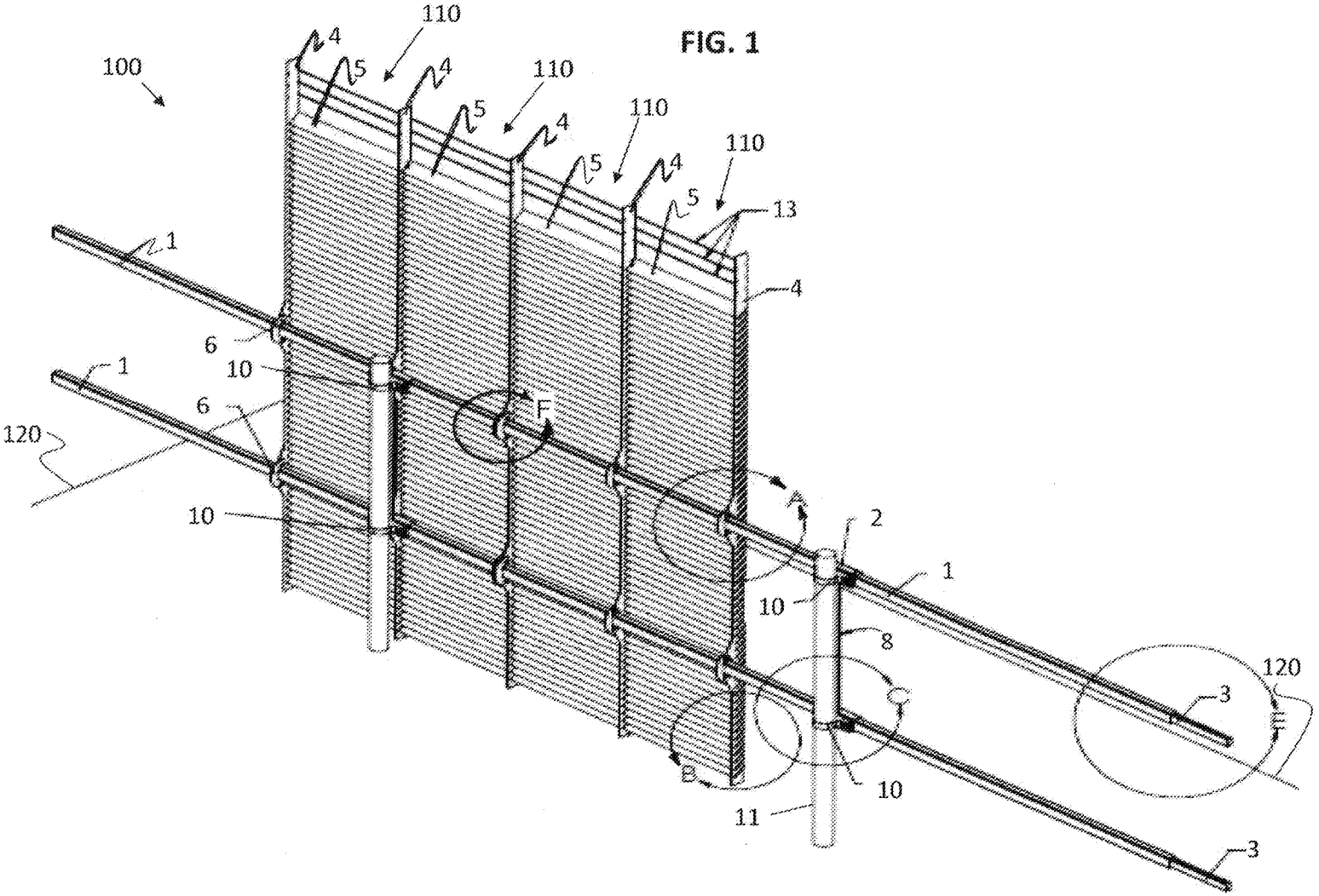
FIG. 1 is a somewhat schematic perspective view of a ballistic fence assembly according to one embodiment of the present inventive concepts.
Figure 2:
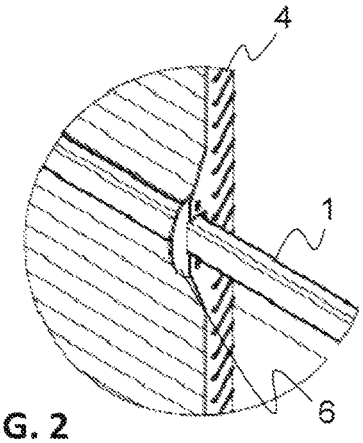
FIG. 2 is a somewhat schematic enlarged perspective drawing of Detail A of FIG. 1 illustrating a connection between a vertical rib and a rail of the ballistic fence assembly according to additional principles of the inventive concepts.
Figure 3:
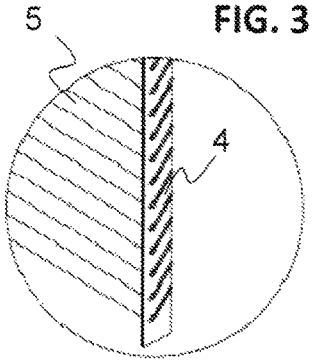
FIG. 3 is a somewhat schematic enlarged perspective drawing of Detail B of FIG. 1 illustrating a connection between the slats and the vertical rib of the ballistic fence assembly according to still further principles of the inventive concepts.

FIG. 1 is a somewhat schematic perspective view of a ballistic fence assembly 100 according to one embodiment of the present inventive concepts. FIG. 2 is a somewhat schematic enlarged perspective drawing of Detail A of FIG. 1 illustrating a connection between a vertical rib 4 and a rail 1 of the ballistic fence assembly 100 according to additional principles of the inventive concepts. FIG. 3 is a somewhat schematic enlarged perspective drawing of Detail B of FIG. 1 illustrating a connection between the slats 5 and the vertical rib 4 of the ballistic fence assembly 100 according to still further principles of the inventive concepts.

Figure 4:
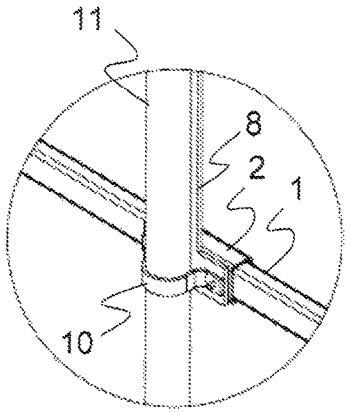
FIG. 4 is a somewhat schematic enlarged perspective view of Detail C of the ballistic fence assembly of FIG. 1, illustrating a connection between a post and a rail of the ballistic fence assembly according to additional aspects of the present inventive principles.
Figure 5:
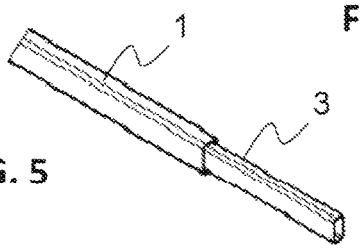
FIG. 5 is a somewhat schematic enlarged perspective view of Detail E of FIG. 1, illustrating a portion of a rail of the ballistic fence assembly.
Figure 6:
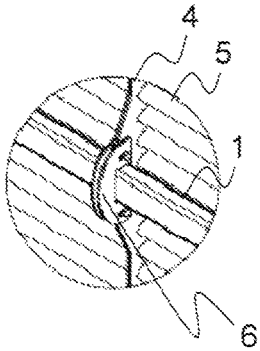
FIG. 6 is a somewhat schematic enlarged perspective view of Detail F of FIG. 1, illustrating a connection between multiple fence panels to the fence rail and post assembly.
Figure 7:
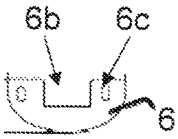
FIG. 7 is a somewhat schematic side view of a panel connector for connecting panels to the rail and post assembly.
Figure 8:
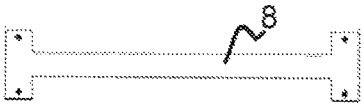
FIG. 8 is a somewhat schematic side view of the rail guide (or rail support bracket) for attaching rails to the posts of the ballistic fence assembly of FIG. 1.

FIG. 4 is a somewhat schematic enlarged perspective view of Detail C of the ballistic fence assembly 100 of FIG. 1, illustrating a connection between a post 11 and a rail 1 of the ballistic fence assembly according to additional aspects of the present inventive principles. FIG. 5 is a somewhat schematic enlarged perspective view of Detail E of FIG. 1, illustrating a portion of a rail 1 of the ballistic fence assembly 100. FIG. 6 is a somewhat schematic enlarged perspective view of Detail F of FIG. 1, illustrating a connection between multiple fence panels 110 to the fence rail 1 and post 11 assembly. FIG. 7 is a somewhat schematic side view of a panel connector 6 for connecting panels to the rail 1 and post 11 assembly. FIG. 8 is a somewhat schematic side view of the rail guide 8 for attaching rails 1 to the posts 11 of the ballistic fence assembly of FIG. 1.

Figure 9:
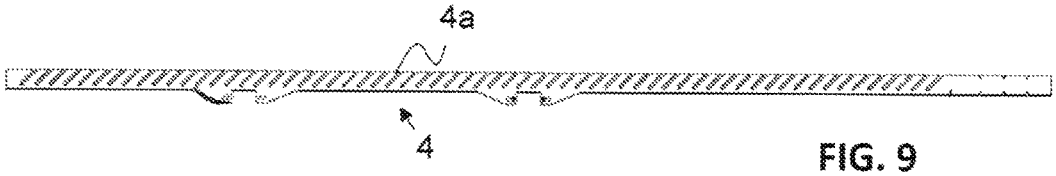
FIG. 9 is a somewhat schematic side view of the vertical rib of the ballistic fence assembly of FIG. 1.
Figure 10:
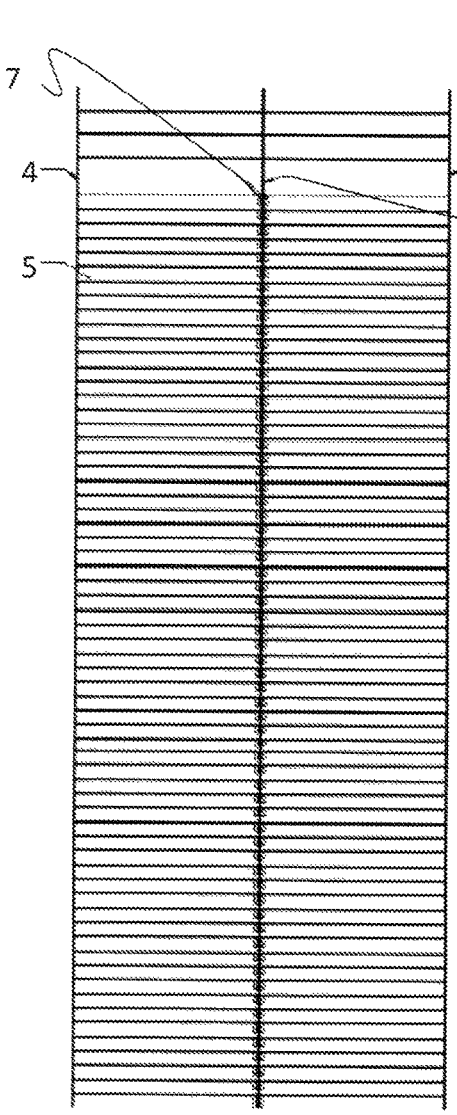
FIG. 10 is a somewhat schematic front view of a panel of the ballistic fence assembly of FIG. 1.
Figure 10A:
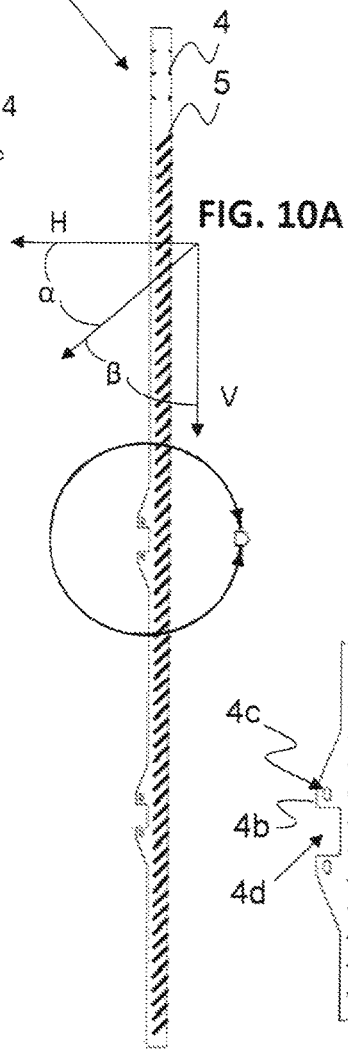
FIG. 10A is a somewhat schematic side view of a vertical rib of the panel of FIG. 10.
Figure 11:
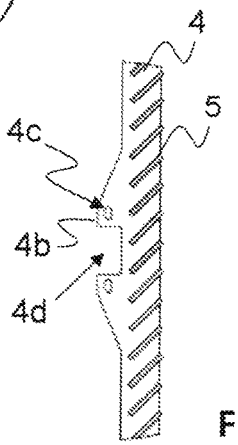
FIG. 11 is a somewhat schematic enlarged side view of Detail D of FIG. 10A, illustrating a portion of the vertical rib for connecting to the rails of the ballistic fence assembly of FIG. 1.

FIG. 9 is a somewhat schematic side view of the vertical rib 4 of the ballistic fence assembly 100 of FIG. 1. FIG. 10 is a somewhat schematic front view of a panel 110 of the ballistic fence assembly 100 of FIG. 1. FIG. 10A is a somewhat schematic side view of the panel 110 of FIG. 10. And FIG. 11 is a somewhat schematic enlarged side view of Detail D of FIG. 10A, illustrating a portion of the vertical rib 4 for connecting to the rails 1 of the ballistic fence assembly 100 of FIG. 1.

Referring to FIGS. 1 through 11, a ballistic barrier 100 can be constructed from a plurality of ballistic panels 110 attached to a post 1 and rail 11 assembly. Each panel 110 may comprise one or more vertical ribs 4 and a plurality of slats 5 attached to the ribs 4. Barbed wire 13 may be attached to an upper portion of the vertical ribs 4.

Referring specifically to FIGS. 1-3, and 9-11, the vertical ribs 4 are preferably slotted to allow the slats 5 to slide into the slots 4*a* in the ribs 4. The slats 5 can then be welded to the vertical rib 4 through a welded connection 7, or fastened to the ribs 4 in any other desirable manner, depending on the customers' preference. The vertical ribs 4 may further include notches 4*d* arranged in protrusions 4*b* at appropriate locations along the back of each rib 4 to receive the rail 1. This allows the rib notches 4*d* to slide onto the horizontal rails 1 and permits the ribs 4 to be secured to the rail 1 using rib brackets/panel connectors 6 (see, e.g., FIGS. 2, 6, and 7).

Referring now to FIGS. 1, 4-8, and 11, the horizontal rails 1 preferably slide through rail supports 2, which may be welded or otherwise affixed to a rail support bracket 8. The rail support bracket 8 may be fastened to the post 11, for example, using pipe clamps 10. Multiple horizontal rails 1 may be joined together using rail connectors 3. And adjacent fence panels 110 may be fastened together using panel connectors 6. The panel connectors 6 may include a slot 6*b* that slides over the rail 1, and may further include holes 6*c* that align with holes 4*c* in the rib protrusions 4*b*. Fasteners such as screws, bolts, or other desired fasteners may be inserted through the holes 6*c* and 4*c* to secure the panels 110 together and to the rail 1.

Generally, a vertical spacing between the slats may depend on what thickness of slat is being used. The thickness of the slats may, in turn, depend on the calibers of bullets which the fence is being designed to withstand. In one embodiment, the slats 5 overlap each other by a minimum distance of ⅛". In one embodiment, each of the slats 5 may have a thickness of approximately about ¼". Of course, the width of the slats can be altered for higher or lower security needs. Changing the width of the slats may also allow for one slat to overlap more or less of the slat above or below it. The width of the slats could be selected, for instance, to provide anywhere between 0 to 100% overlap with an adjacent slat, thereby creating a ballistic barrier providing much lower or higher security, respectively. For instance, greater overlap would provide greater redundancy and therefore heightened security, while lower overlap would provide reduced security but also reduced costs. For ease of handling and installation, a preferred length of each slat 5 may be approximately about 48" and a preferred width may be approximately about 2¾".

Referring specifically to FIG. 10A, in one embodiment, each of the slats 5 may be arranged at an angle β of approximately 45 degrees from downward vertical V. This embodiment has been found to be effective at deflecting bullets from a variety of assault rifles in a short distance. The slats may also, however, be provided at various other angles α, β, with respect to horizontal H or vertical V. Furthermore, each of the slats may be oriented at substantially the same angle as each of the other slats, or the slats may be arranged at various different angles. The distance beyond the fence which a bullet is permitted to travel after striking a slat may be partially determined by the angle at which the slat is arranged.

In one embodiment, the slats 5 are each arranged to provide a downward facing outward surface arranged at an angle β of approximately about 45 degrees with respect to vertically downward V, and the ballistic fence 100 will deflect an incoming bullet to the ground 120 no further from the fence 100 than the height at which the bullet strikes the fence 100. Accordingly, if the bullet hits the fence 100 at a height of about six feet from the ground 120, for instance, it will travel no further than about six feet beyond the fence.

Of course, within the inventive concepts, each of the horizontal slats may be arranged at any desired angle α, β, for that particular slat within the panel. The angle of orientation α, β, of each slat may further be varied, for instance, depending on the height at which the slat is arranged. The slats may comprise any desired length, any desired width, any desired thickness, and any desired grade or alloy of steel or other material sufficient to withstand the impact of a bullet and redirect it in the desired direction. The slats may further be designed having any of a variety of thicknesses and materials to stop different calibers of bullets depending on their desired implementations.

Alternative spacing and slat angles may be desired depending on a given application. Slats with an angle α of 45 degrees or less from horizontal H will be more effective in deflecting higher caliber bullets (because a smaller portion of the bullet will impact the slat before deflection), but will also allow the bullets to travel a greater distance from the point of contact with the fence panel. Slats with an angle α of 45 degrees or greater from horizontal H, however, can be effective in deflecting lower caliber bullets and will cause the bullets to travel a shorter distance from the point of contact with the fence panel.

Any slat material or composition of materials that can sufficiently withstand a bullet impact and redirect its direction of travel is within the contemplation of the current inventive concepts. A preferred material, however is any steel with a chemical composition consisting of the following: Carbon (C) content of 0.31% or less, Copper (Cu) content of 0.21% or less, Iron (Fe) content of 90% or less, Manganese (Mn) content of 0.08% or higher, Phosphorus (P) content of 0.05% or lower, Silicon (Si) content of 0.20% or higher, Sulfur (Su) content of 0.06% or lower, Chromium (Cr) content of 0% or higher, Nickel (Ni) content of 0% or higher, Molybdenum (Mo) content of 0% or higher, and Boron (B) content of 0% or higher. Any steel capable of stopping or redirecting the bullet, for instance, would be acceptable. A preferred chemical composition for the slat material is: (C-0.30%) (Fe-93.76%) (P-0.020%) (Si-0.70%) (S-0.010%) (Cr-1.5%) (Ni-1.5%) (Mo-0.60%) (B-0.005%).

A brief description of bullet trajectory with respect to one embodiment will now be provided with reference to FIGS. 1-11. With the slats 5 arranged at an angle of 45 degrees, an incoming bullet will deflect off the fence panel 110 at an angle of no less than 45 degrees. Therefore, if a bullet were to hit the fence panel 110 at a height of about six feet above the ground, the bullet would not travel more than about six feet beyond the inside of the fence panel 110. Generally, however, it has been discovered through testing that panels arranged at an angle of 45 degrees will direct the bullets to ground at an angle greater than 45 degrees. This is likely due to the bullets having a ricochet effect off the panel, directing the bullet to the ground at a steeper angle. In one test, for example, when the panel was shot at a height of 24", the bullet fragments hit the ground 20" behind the target.

Figure 12:
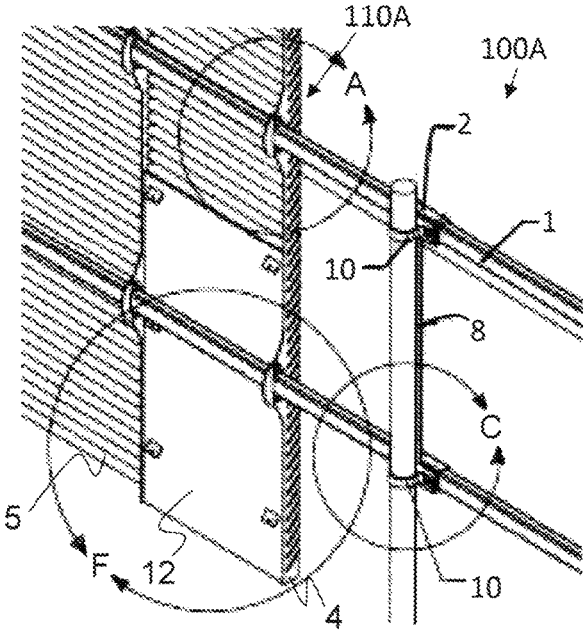
FIG. 12 is a somewhat schematic perspective view of a ballistic fence assembly having a backer plate according to another embodiment of the inventive concepts.
Figure 12A:
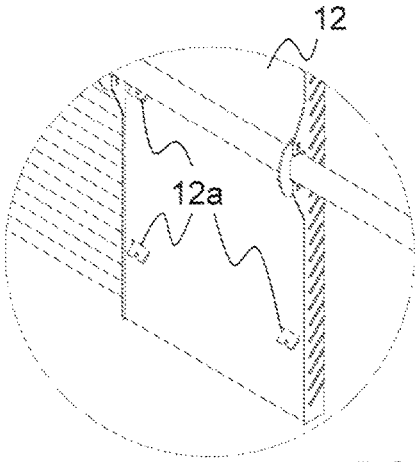
FIG. 12A is an enlarged perspective view of Detail F of FIG. 12, further illustrating the backer plate arranged on the ballistic fence assembly.

Alternative embodiments and additional features are also contemplated. FIG. 12 is a somewhat schematic perspective view of a ballistic fence assembly 100A having a backer (or backing) plate according to another embodiment of the inventive concepts, and FIG. 12A is an enlarged perspective view of Detail F of FIG. 12, further illustrating the backer plate arranged on the ballistic fence assembly 100A. Referring to FIGS. 12 and 12A, in this embodiment, the fence panel 110A may be further provided with one or more backer plates 12 mounted on the back of the fence panel 110A to help contain bullets and prevent them from travelling any appreciable distance beyond the fence 100A. Backer plates 12 could be attached to the fence panel 110A, for instance, by inserting them in between vertical ribs 4 and attaching them by way of welding, or by way of pins (not shown) that are inserted through holes in protruding parts 12*a* of the slats 5, thereby attaching the backer plate 12 to the horizontal slats 5. Any other suitable attachment mechanism is also contemplated.

In an embodiment having a backer plate, for instance, the bullet would hit the angled slat directing the bullet downward (or upward) at an angle where it would then hit the backer plate. The backer plate would redirect the bullet again, preferably straight down or substantially straight down to the ground. In embodiments having a backer plate, therefore, a kill zone behind the ballistic barrier can be substantially reduced or eliminated.

In a still further embodiment, a serrated sheet metal, a corrugated sheet metal, or a wire mesh facing (not shown) could be mounted to the front of the panel to help prevent people from being able to climb the fence panels.

Figure 13:
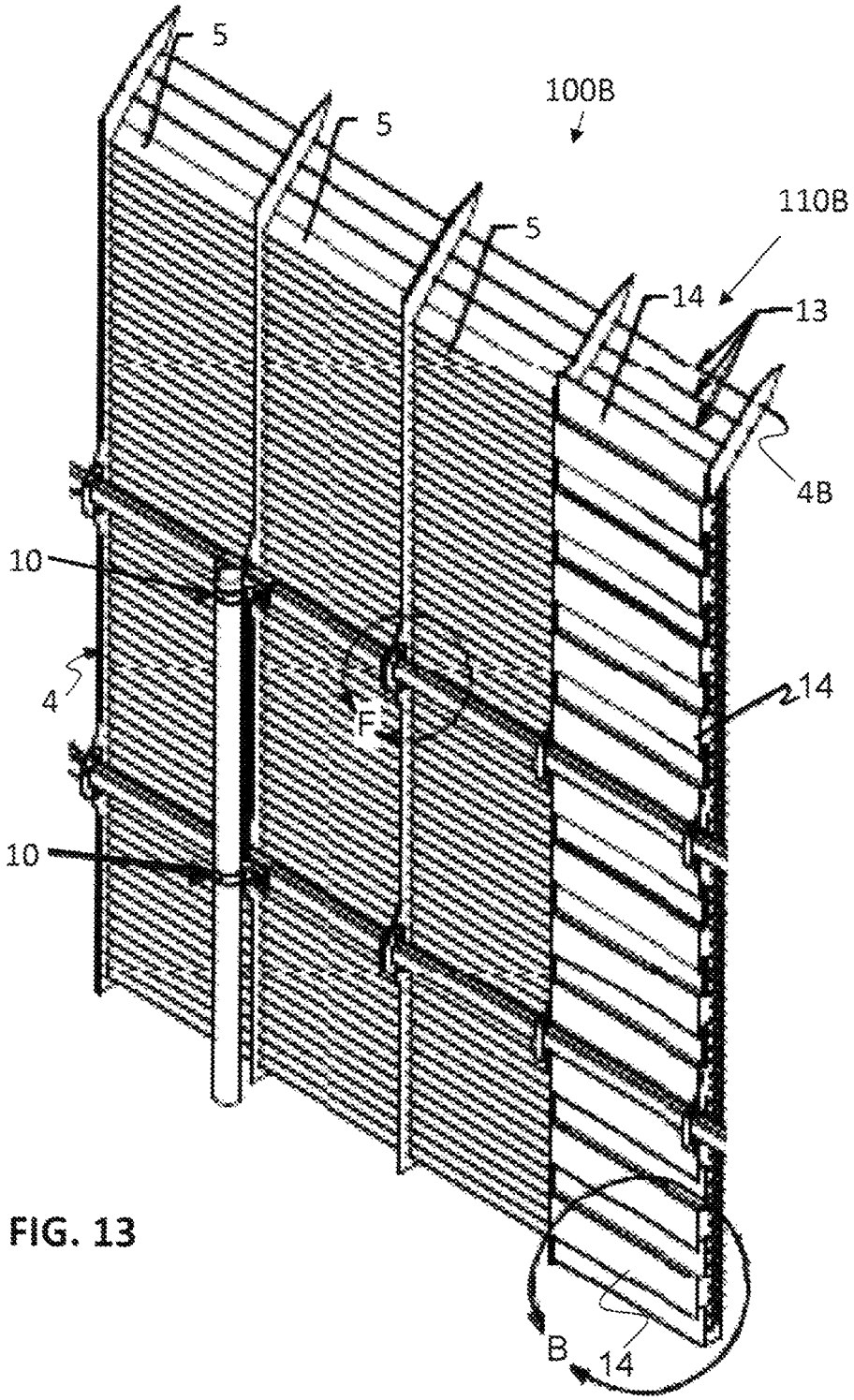
FIG. 13 is a somewhat schematic perspective view of a ballistic fence assembly having backer plates or fence covers arranged to provide ventilation according to a still further aspect of the present inventive concepts.

Yet another embodiment of the present inventive concepts is shown in FIGS. 13-13C. The ballistic fence 100B of this embodiment may be generally constructed in a manner similar to the previous embodiments, with multiple fence panels 110B arranged to form a ballistic fence assembly 100B, and a detailed description of redundant features will be omitted here.

Referring to FIGS. 13-13C, unlike the previous embodiments, a ballistic fence 100B according to an alternative embodiment may include fence panels 110B provided with backer plates (or fence covers) 14 that provide ventilation to an inside of the fence through gaps 15 arranged between fence covers 14. More particularly, each of the fence covers 14 may have a substantially stair-shaped structure having a base portion 14*a* that fits within a receptacle 4Be of the vertical ribs 4B, and a raised portion 14*b* that abuts against a raised portion 4Bf of the ribs 4B. A part of the raised portion 14*b* may overlap a base portion 14*a* of another one of the fence covers 14 in the horizontal direction. In this manner, a gap 15 can be provided between adjacent fence covers 14 that allows air to flow between the fence covers 14 and circulate between an inside and an outside of the ballistic fence assembly 100B, while still permitting the fence covers 14 to block any incoming bullets from entering the fenced area. In addition, an upper portion 4Ba of the rib 4B, to which barbed wire 13 may be attached, may be angled outwardly.

Having described and illustrated principles of the present inventive concepts in various preferred embodiments thereof, it should be apparent that the invention can be modified in arrangement and detail without departing from such principles. I therefore claim all modifications and variations coming within the spirit and scope of the following claims.

What is claimed is:

1. A ballistic barrier comprising:

a plurality of panels connected together to form a fence, each panel comprising:

one or more substantially vertically extending ribs, wherein an inside portion of each of the ribs comprises a plurality of stepped-up portions and a plurality of stepped-down portions;

a plurality of substantially horizontally extending slats connected to the one or more ribs, each slat having an outward facing surface arranged at a downward sloping angle with respect to a horizontal direction, wherein each slat is constructed of a material capable of deflecting an incoming bullet downward toward the ground to protect persons or property inside the fence;

a plurality of partially overlapping backer plates arranged on an inside of the ballistic barrier to prevent movement of the incoming bullet past the ballistic barrier, wherein the plurality of backer plates are alternately arranged along the stepped-up and stepped-down portions of the ribs to provide a gap between adjacent backer plates to permit air to circulate between an inside and an outside of the ballistic barrier between adjacent backer plates, and wherein each of the backer plates arranged along the stepped-down portions of the ribs are substantially vertically aligned with each other and wherein each of the backer plates arranged along the stepped-up portions are substantially vertically aligned with each other.

2. The ballistic barrier of claim 1, wherein the backer plates are each arranged substantially vertically along an inside portion of the ribs.

3. The ballistic barrier of claim 1, wherein there is no direct connection between adjacent backer plates inbetween adjacent ribs.

4. The ballistic barrier of claim 1, wherein the gap between adjacent backer plates is sized sufficiently to permit the circulation of air between an interior and an exterior of the ballistic barrier.

5. The ballistic barrier of claim 1, wherein the backer plates are each connected to the ribs but not directly to each other.

6. The ballistic barrier of claim 1, wherein each of the backer plates is arranged vertically along either a stepped-up portion or a stepped-down portion of a connected rib to provide the gap between adjacent backer plates.

7. The ballistic barrier of claim 1, further comprising posts extending substantially vertically from a ground surface; and rails connected substantially horizontally between the posts, wherein each rail is configured to support two or more of the plurality of panels.

8. The ballistic barrier of claim 7, wherein each rail is connected to a corresponding post using a rail bracket and rail support, said rail bracket physically attached to the post, and said rail support physically attached to the rail bracket, said rail support further having an opening therethrough to receive the corresponding rail therein.

9. The ballistic barrier of claim 8, wherein the rail bracket is connected to the post via a pipe clamp.

10. The ballistic barrier of claim 1, wherein the angle is selected to deflect the incoming bullet to a ground surface within a few feet of the inside of the ballistic barrier.

11. The ballistic barrier of claim 10, wherein the angle is approximately 45 degrees downward from horizontal.

12. The ballistic barrier of claim 1, further comprising a plurality of slots formed in each of the ribs to receive the plurality of slats, wherein each of the slots is formed having an opening on an outward side of the ribs.

13. A panel for a ballistic barrier, said panel comprising:

a plurality of ribs, each rib extending in a vertical direction, and wherein each of the plurality of ribs comprises a plurality of alternately arranged stepped-up and stepped-down portions;

a plurality of slats constructed of bullet-resistant material connected to the plurality of ribs, wherein each slat is arranged at a downward sloping angle to deflect an incoming bullet toward a ground surface; and a plurality of backing plates each arranged substantially vertically along the ribs, wherein the plurality of backing plates are alternately arranged along the stepped-up and stepped-down portions of the ribs to provide a gap between adjacent backing plates, and wherein each of the backing plates arranged along the stepped-down portions of the ribs are substantially vertically aligned with each other and wherein each of the backing plates arranged along the stepped-up portions are substantially vertically aligned with each other.

14. The panel according to claim 13, wherein the stepped-up portions extend horizontally-outward away from the slats, and wherein the stepped-down portions are recessed horizontally-inward toward the slats.

15. The panel according to claim 14, wherein portions of the backing plates arranged along the stepped-up portions extend over and overlap portions of adjacent backer plates on the stepped-down portions of the rib to provide the gap between adjacent backing plates that allows the flow of air therethrough.

16. The panel according to claim 13, wherein each of the backing plates comprises a bullet-resistant material.

17. A ballistic barrier comprising:

a plurality of ribs having stepped-up portions and stepped-down portions;

a plurality of slats connected between the plurality of ribs and arranged at an angle with respect to the ribs;

each slat comprising a bullet resistant material capable of deflecting an incoming bullet from its original path; and a plurality of backer plates arranged on the ribs, wherein adjacent backer plates partially overlap each other in a horizontal direction with a gap arranged therebetween to permit air flow between the backer plates to an interior of the ballistic barrier, wherein the plurality of backer plates are alternately arranged along the stepped-up and stepped-down portions of the ribs to provide a gap between adjacent backer plates, wherein each of the backer plates arranged along the stepped-down portions of the ribs are substantially vertically aligned with each other, and wherein each of the backer plates arranged along the stepped-up portions are substantially vertically aligned with each other.

18. The ballistic barrier of claim 17, wherein the stepped-up portions extend horizontally-outward away from the slats, and wherein the stepped-down portions are recessed horizontally-inward from the stepped-up portions toward the slats.

19. The ballistic barrier of claim 18, further comprising a plurality of posts extending substantially vertically from a ground surface.

20. The ballistic barrier of claim 19, further comprising one or more rails rigidly connected to and extending substantially horizontally between the posts, wherein the plurality of ribs are connected to the one or more rails, such that each rail supports multiple ribs.

* * * * *